US007261442B2

(12) United States Patent
Chiu

(10) Patent No.: US 7,261,442 B2
(45) Date of Patent: Aug. 28, 2007

(54) WIRELESS REMOTE CONTROL PORCH LIGHT

(75) Inventor: Shin-Yung Chiu, 1F., No. 5, Lane 35, Sec. 2, Baoyuan Rd., Sindian City, Taipei County (TW) 231

(73) Assignees: Shin-Yung Chiu, Taipei County (TW); David Worsham, Alabaster, AL (US)

( * ) Notice: Subject to any disclaimer, the term of this patent is extended or adjusted under 35 U.S.C. 154(b) by 40 days.

(21) Appl. No.: 11/333,273

(22) Filed: Jan. 18, 2006

(65) Prior Publication Data

US 2007/0109781 A1 May 17, 2007

(30) Foreign Application Priority Data

Nov. 16, 2005 (TW) ..... 094219862

(51) Int. Cl.
*H01K 1/62* (2006.01)

(52) U.S. Cl. ..... 362/372; 362/371; 362/147; 362/233; 362/276

(58) Field of Classification Search ..... None
See application file for complete search history.

(56) References Cited

U.S. PATENT DOCUMENTS 5,673,989 A * 10/1997 Gohl et al. ..... 362/35
6,655,817 B2 * 12/2003 Devlin et al. ..... 362/233
6,955,447 B2 * 10/2005 Lui ..... 362/233
7,137,721 B1 * 11/2006 Rao et al. ..... 362/371
2005/0243549 A1 * 11/2005 Ruston ..... 362/233

* cited by examiner

*Primary Examiner*—Renee Luebke
*Assistant Examiner*—Kristen A Manskar
(74) *Attorney, Agent, or Firm*—Bacon & Thomas, PLLC

(57) ABSTRACT

A wireless remote control porch light is installed on outer wall or under the eaves of a building with function of remotely controlling to adjust and vary light beam's direction very suitable for courtyard or door illuminating of the building, which comprises a base seat, a rotation connecting seat, a fixed seat, a rotation driving seat, a movable lamp holder and a waterproof rubber sleeve, wherein the rotation connecting seat comprises a swivel driving device, an axial rotation driving device and a radio signal receiver among which the radio signal receiver can receive RF signal for controlling the swivel driving device to drive the lamp holder to move angularly in forward and backward direction or for controlling the axial rotation driving device to drive the rotation driving seat and the rotation connecting seat to rotate jointly about the axis of the rotation driving seat.

8 Claims, 6 Drawing Sheets

WIRELESS REMOTE CONTROL PORCH LIGHT

BACKGROUND OF THE PRESENT INVENTION

1. Field of the Invention

The invention relates to a wireless remote control porch light, particularly a wireless remote control porch light with direction of light beam can be varied by means of RF (radio frequency) control technique.

2. Description of the Prior Art

Normally the porch light for a building is installed on the outer wall or under the eaves of the building, and has a light beam aimed at fixed direction to illuminate a fixed place. However when some places or any corner in the courtyard or any place in front of the door of building need to be illuminated, it is impossible to make immediate change of the direction of the light beam of the conventional type porch light.

Another type of porch light popularly used is controlled by sensor to enable an automatic ON/OFF function which when an object approaching the door is detected by sensor the porch light will be turned on automatically, whereas if the sensor doesn't detect any object, the porch light will be turned off automatically.

However, these types of porch lights with automatic control function to turn on and off the light by means of sensor are still unable to make immediate change of the direction of its light beam.

In other words, the conventional type of porch light popularly used today all are unable to have the direction of its light beam varied or to be turned on and off by means of RF remote control at any time whenever required by user.

SUMMARY OF THE INVENTION

The major purpose of the invention is to provide a wireless remote control porch light which can be installed on outer wall or under the eaves of building, and is able to have its light beam's direction angularly adjusted in different horizontal and vertical direction; the user can turn on, and turn off the porch light or change its light beam's direction from a remote place by means of RF remote control.

The structure of porch light of the invention comprises a base seat, a rotation connecting seat, a fixed seat, a rotation driving seat, a movable lamp holder and a waterproof rubber sleeve, wherein the fixed seat and the rotation connecting seat are jointly installed on the base seat to form pivotal assembly with the base seat, and the movable lamp holder is pivotally mounted on the inner side of the rotation driving seat which is connected to the rotation connecting seat to form an interlinked assembly able to move synchronously with each other; the fixed seat has a internal ring gear; the movable lamp holder has a circular gear rack formed on the back side, and the rotation driving seat has a swivel driving device, an axial rotation driving device and a radio signal receiver mounted on the back side of the rotation driving seat of which the swivel driving device of the rotation driving seat can drive the circular gear rack of the movable lamp holder to cause the lamp holder to move angularly in forward and backward direction to change the light beam of the porch light angularly by means of RF remote control.

The axial rotation driving device of the rotation driving seat has a driving gear to engage with the internal ring gear of the fixed seat. Since the fixed seat is fastened on the base seat, when the driving gear of the axial rotation driving device rotates, the rotation driving seat and the rotation connecting seat both will rotate as a whole unit to cause the movable lamp holder to move in rotation motion to vary the angular position of the light beam. The radio signal receiver can receive RF signal, and control the electric power supply to the light bulb on the lamp holder or control the electric power supply to the reversible rotation motor of the axial rotation driving device or the reversible rotation motor of the swivel driving device. The waterproof rubber sleeve is shaped like a cover with bellows structure to provide waterproof effect of the wireless remote control porch light of the invention.

The minor purpose of the invention is to provide a wireless remote control porch light which in addition to the function of adjustable angle of light beam in transverse direction and vertical direction, can also limit the movement of the light beam within the desired angular range.

DETAILED DESCRIPTION OF THE INVENTION

Figure 1:
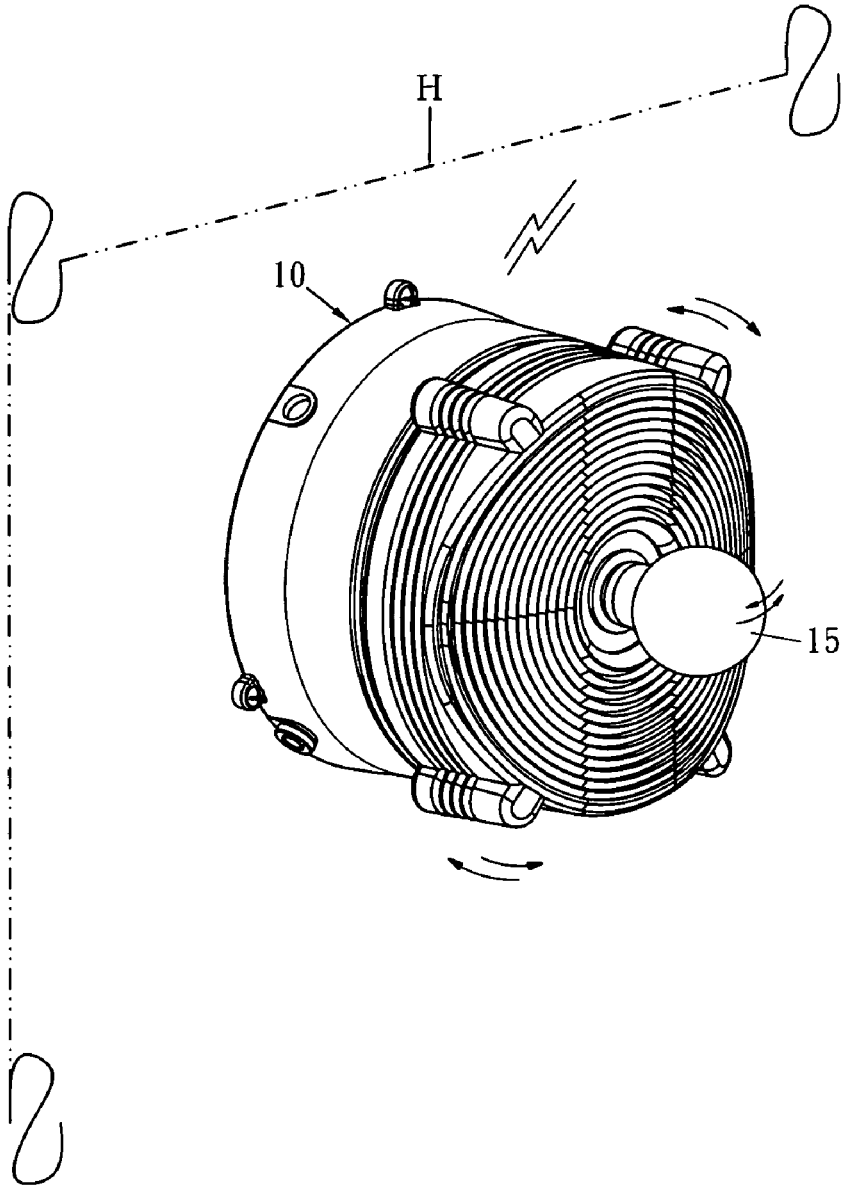
FIG. 1 is application drawing of the wireless remote control porch light of the invention.

Referred to FIG. 1, the wireless remote control porch light 10 of the invention is used as an illumination equipment for night time which can be installed on outer wall or under the eaves of a building H, and can be turned on or off by user by means of RF remote control for courtyard's illuminating or door's illuminating of the building. The light beam's direction of the invented porch light 10 can be changed and controlled by user by means of RF control to have the light beam with applicably illuminating direction to illuminate the courtyard or the area in front of a door of the building H.

Referred to from FIG. 2 to FIG. 6, the structure of wireless remote control porch light 10 of the invention comprises a waterproof rubber sleeve 20, a movable lamp holder 30, a rotation driving sent 40, a pair of shaft cover 50, a fixed seat 60, a rotation connecting seat 70 and a base seat 80.

Figure 5:
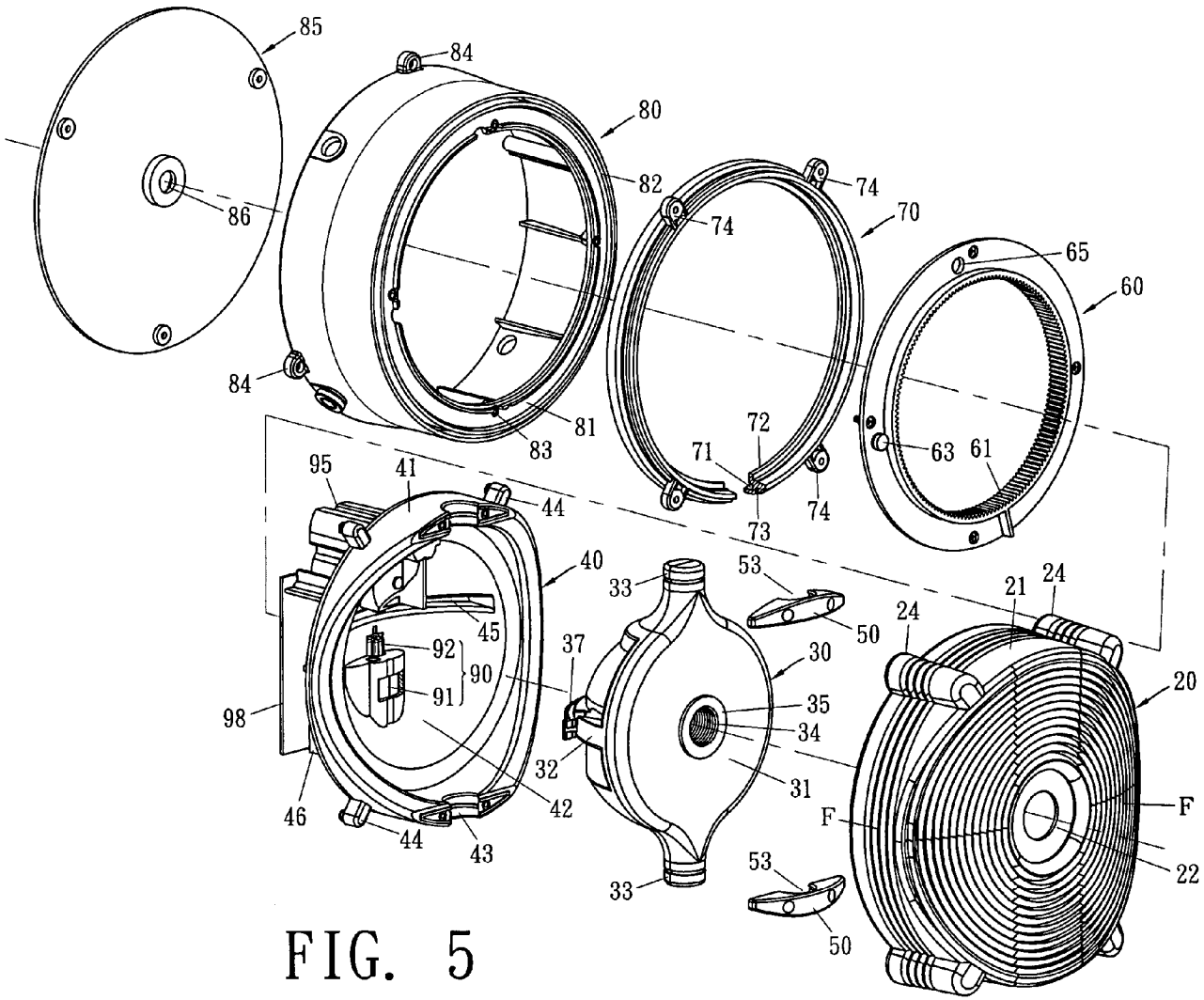
FIG. 5 is the disassembly drawing of the wireless remote control porch light of the invention showing the relation between each part for being assembled together.
Figure 6:
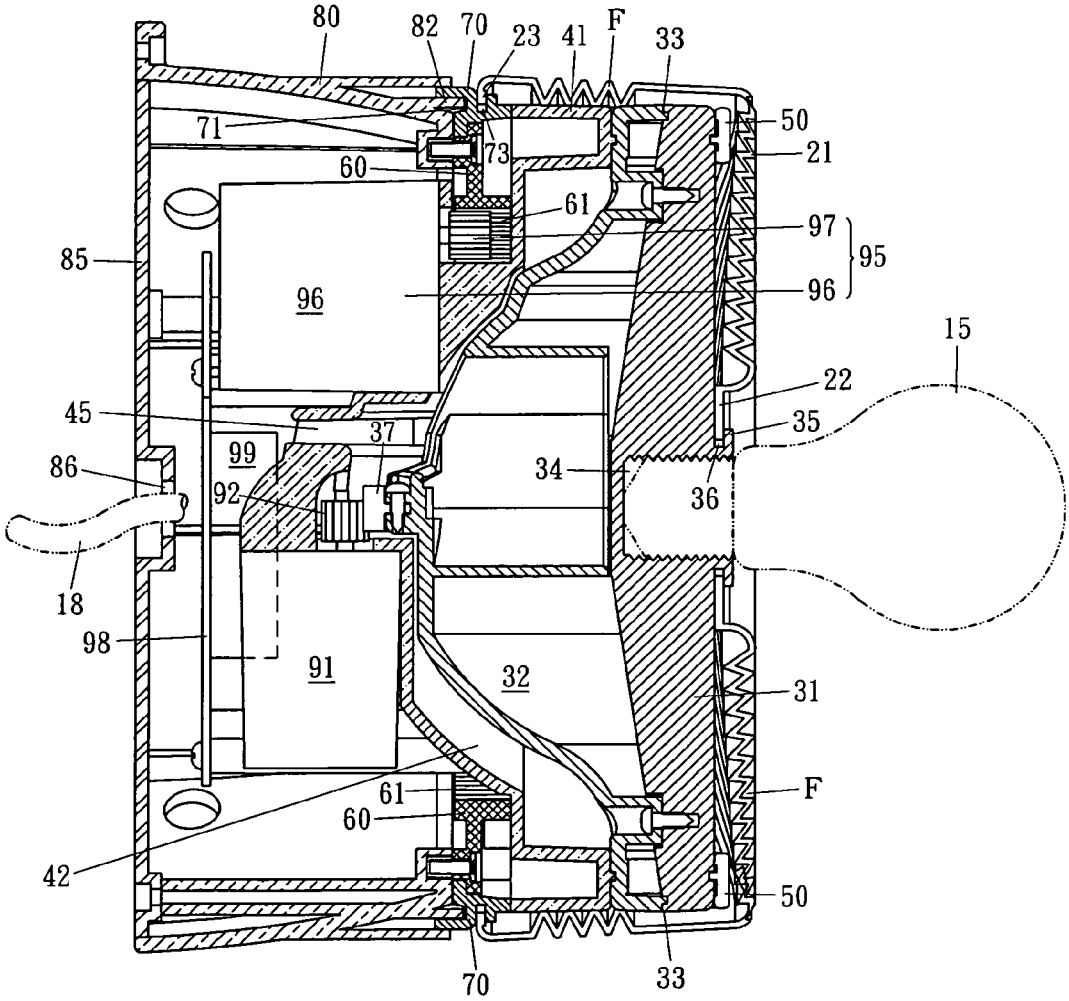
FIG. 6 is the internal structure of the wireless remote control porch light of the invention.

As shown in FIGS. 5 and 6, the fixed seat 60 and the rotation connecting seat 70 are jointly installed on the base seat 80, but the rotation connecting seat 70 is a movable part which is mounted on the base seat 80 by means of the fixed seat 60 to form pivotal connection between the rotation connecting seat 70 and the base seat 80.

The base seat 80 is a hollow housing which has a ring shaped groove 81 and a ring shaped rib 82 formed on the top surface with fastening holes 83 formed in the ring shaped groove 81, and on the bottom side of the housing is a bottom cover 85, and a penetrating hole 86 through which an electric cable 18 is connected to the inner side of the base seat 80.

Referred to FIGS. 1 and 5, plural protrudent portions 84 are formed along outer edge of the bottom surface of the base seat 80; by employing the protrudent portion 84, the wireless remote control porch light 10 of the invention can be installed on the outer wall or under the eaves of building H.

Referred to FIGS. 5 and 6, the rotation connecting seat 70 is a ring shaped part which has a sliding groove 71 and an inner flange 72. The sliding groove 71 is designed to fit the ring shaped rib 82 of the base seat 80, and maintains a pivotal connection between the base seat 80 and the rotation connecting seat 70. The rotation connecting seat 70 further has a groove 73 formed circularly on the outer surface, and has plural connecting portions 74.

Referred to FIGS. 5 and 6, the fixed seat 60 is also a ring shaped part having a internal ring gear 61. The fixed seat 60 is installed on the base seat 80 by fastening screws through the holes 83 on the base seat 80. Since the rotation connecting seat 70 and the fixed seat 60 both are assembled together and jointly installed on the base seat 80, the fixed seat 60 can stop the inner flange 72 of the rotation connecting seat 70 to prevent separation of the rotation connecting seat 70 from the base seat 80, and enable a pivotal connection between the base seat 80 and the rotation connecting seat 70, so that the rotation connecting seat 70 can move in rotating motion relative to the fixed seat 60 and the base seat 80.

Referred to from FIG. 3 to FIG. 6, the movable lamp holder 30 comprises an upper housing 31 and a lower housing 32 which mutually form a pair of pivotal shafts 33 on both sides of the movable lamp holder 30. The upper housing 31 has a light bulb socket 34 which is connected to the electric cable 18 extended into the bass seat 80 to form an electric connection for supplying electric power to the light bulb 15.

On top side of the upper housing 31, a flange 35 is provided to form a ring shaped groove 36. On back side of the lower housing 32 has a curved surface which carries a circular gear rack 37.

Referred to FIGS. 5 and 6, the rotation driving seat 40 has a mainbody 41 and a recession 42 formed on the mainbody 41 for accommodating and installing the movable lamp holder 30. There are two semicircular shaft holes 43 are oppositely formed on both sides of the mainbody 41 for mounting the pair of pivotal shafts 33 of the movable lamp holder 30, and a pair of shaft covers 50 having the same semicircular shaft hole 53 are correspondingly installed to fit the semicircular shaft hole 43 of the rotation driving seat 40 for mounting the pair of pivotal shafts 33 of the movable lamp holder 30 to be formed as a pivot connection with the rotation driving seat 40 to enable the lamp holder 30 capably make a rotating motion in the recession 42 of the rotation driving seat 40.

Referred to FIGS. 5 and 6, on back side of the mainbody 41 of the rotation driving seat 40 are formed with a swivel driving device 90, an axial rotation driving 95 and a printed circuit board 98 carrying radio signal receiver 99, wherein the swivel driving device 90 is structured to comprise a reversible rotation motor 91 and a driving gear 92 which engages with the circular gear rack 37 designed on back side of the lower housing 32 of the movable lamp holder 30.

Figure 4:
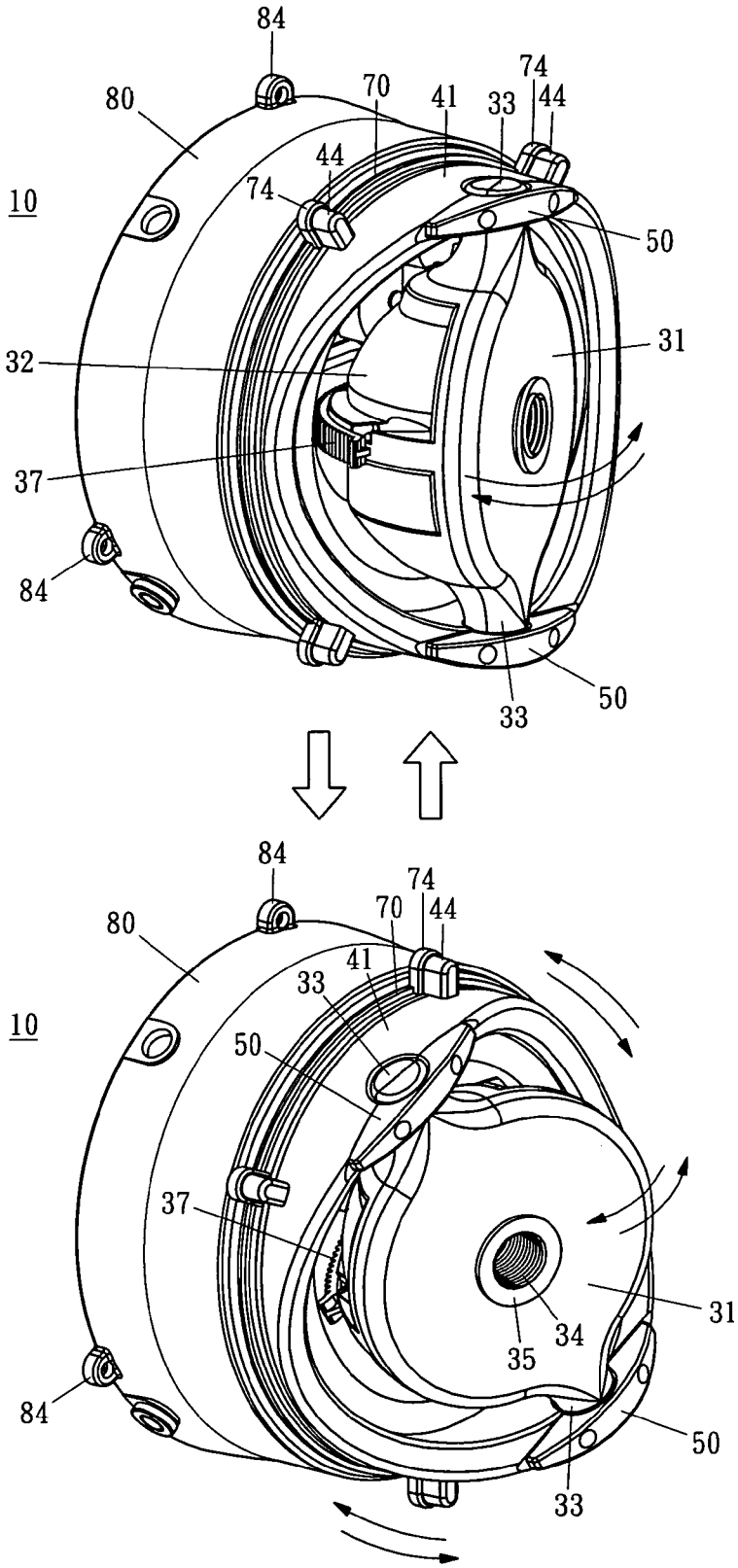
FIG. 4 is the illustration drawing which shows that the light beam of the wireless remote control porch light of the invention can vary through different angular position.

Referred to FIGS. 4 and 6, the reversible rotation motor 91 of the swivel driving device 90 is connected to one set of the electric cable 18 extended into the base seat 80 to form electrical connection. By employing the reversible rotation motor 91, the movable lamp holder 30 can be driven by the driving gear 92 to move angularly in forward and backward direction in the recession 42 of the rotation driving seat 40 to vary the illumination angle of the wireless remote control porch light 10 of the invention.

Referred to FIGS. 5 and 6, the recession 42 of the rotation driving seat 40 has a long slot 45 for the electric cable 18 to pass through and connect to the light bulb 34 on the movable lamp holder 30. When the movable lamp holder 30 moves, the long slot 45 of the rotation driving seat 40 has the effect of preventing tangling of the electric cable 18.

Figure 3:
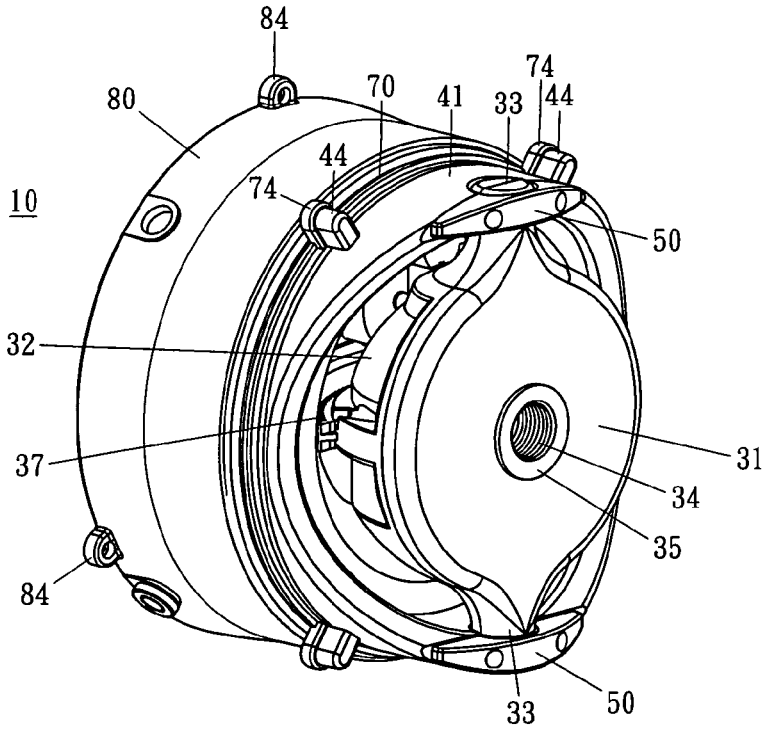
FIG. 3 is the schematic drawing of the wireless remote control porch light of the invention with the waterproof rubber sleeve removed.

Referred to FIGS. 3 and 5, on the outer side of the main body 41 of the rotation driving sent 40 has plural connecting portions 44 corresponding to the connecting portions 74 of the rotation connecting seat 70. And, by installing together the connecting portions 44 of the rotation driving seat 40 and the connecting portions 74 of the rotation connecting seat 70 the rotation driving seat 40 and the rotation connecting seat 70 can be assembled together to form a complete unit interlinked with each other.

The structure of the axial rotation driving device 95 of the rotation driving seat 40 is shown in FIG. 6 which comprises a reversible rotation motor 96 and a driving gear 97. When the rotation driving seat 40 and the rotation connecting seat 70 are installed together to form a complete unit, the swivel driving device 90, the axial rotation driving device 95 and the radio signal receiver 99 are located inside the base seat 80, and the driving gear 97 of the axial rotation driving device 95 engages with the internal ring gear 61 of the fixed seat 60.

Referred to FIGS. 4 and 6, one set of the electric cable 18 inside the base seat 80 is connected to the reversible rotation motor 96 to form electric connection. Since the fixed seat 60 is a immovable fixed part, the driving gear 97 on the reversible rotation motor 96 can drive the rotation driving seat 40 and the rotation connecting seat 70 to rotate synchronously as a whole unit in clockwise and counter clockwise direction to vary the angle of light beam jointly with the swivel driving device to enable the effect of varying the illumination angle.

Referred to FIGS. 5 and 6, the waterproof rubber sleeve 20 is a flexible part having a cover-shaped main body 21 which has its top and side surface formed into plaited structure F. On outer side of the mainbody 21 of the waterproof rubber sleeve 20 has plural shielding covers 24 corresponding to the connecting portions 44 of the rotation driving seat 40. On top side of the main body 21 of the waterproof rubber sleeve 20, a penetrating hole is provided to form a mounting hole 22, and along the inner edge of bottom side of the main body 21 is an inner flange 23.

Figure 2:
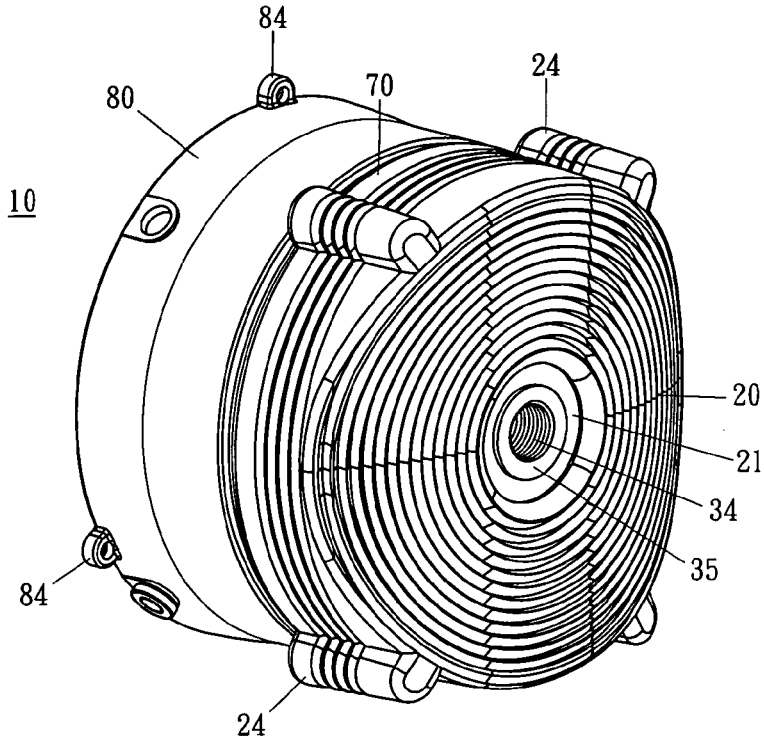
FIG. 2 is the three dimensional drawing of the wireless remote control porch light of the invention.

Referred to FIGS. 2 and 6, the waterproof rubber sleeve 20 is installed in such a way that the mounting hole 22 on the main body 21 of the waterproof rubber sleeve 20 is fitted into the ring shaped groove 36 on the upper housing 31 of the movable lamp holder 30, and the shielding covers 24 of the main body 21 of the waterproof rubber sleeve 20 are installed on the connecting portions 44 of the rotation driving seat 40 respectively, and the flange 23 of the waterproof rubber sleeve 20 is inserted into the groove 73 on the rotation connecting seat 70.

When the rotation driving seat 40 and the rotation connecting seat 70 rotate synchronously in clockwise and counter clockwise direction, the waterproof rubber sleeve 20 can move following the motion of the rotation driving seat 40 and the rotation connecting seat 70. Also when the movable lamp holder 30 pivotally mounted in the recession 42 of the rotation driving seat 40 swivels the waterproof rubber sleeve 20 with plaited structure F can flexibly extend and contract following the motion of the rotation driving seat 41 and the rotation connection seat 70. And, by employing the waterproof rubber sleeve 20, the effect of preventing water seeping into the wireless remote control porch light 10 of the invention can be achieved.

As depicted in FIG. 6, the electric power for the wireless remote control porch light 10 of the invention is supplied through the electric cable 18 which comprises three sets of electric power cord, and, after the three sets of electric power cord had respectively been connected to three different output ends of the radio signal receiver 99 to form electric connection, one of the three sets of electric power cord of the electric cable 18 is connected to the light bulb socket 34 of the movable lamp holder 30 for supplying power to the light bulb 15, and another two power cords of the electric cable 18 are connected to the two reversible rotation motors 91 and 96 separately for supplying power to the motors to rotate in both directions.

Then, as shown in FIG. 1, when the radio signal receiver 99 receives RF signal emitted by the RF signal emitter from far away place, the light bulb 15 of the wireless remote control porch light 10 of the invention can be turned on and off, by controlling the power supplied through one set of the power cable 18, and while under the illumination condition the illumination angle of the wireless remote control porch light 10 of the invention can be varied in vertical and horizontal direction to control and move the light beam of the wireless remote control porch light 10 to be lighted on the place in the courtyard or in front of a door of the building H where illumination is required.

Referred to FIG. 5, another example of embodiment of the wireless remote control porch light 10 of the invention is that the fixed seat 60 may have two or more holes 65 for selectively inserting a pin 63, and the rotation driving seat 40 has a stopper plate 46 formed on the back side, so that when the rotation driving seat 40 rotate about its center line, the pin 63 on the fixed seat 60 will stop the stopper plate 46 on the rotation driving seat 40 to limit the rotating angle of the rotation driving seat 40. Therefore, by inserting the pin 63 on different holes 65 located at different position on the fixed seat 60, the illumination angle of the wireless remote control porch light 10 of the invention can be limited within a selected angular range corresponding to the position of the pin 63.

Figure 7:
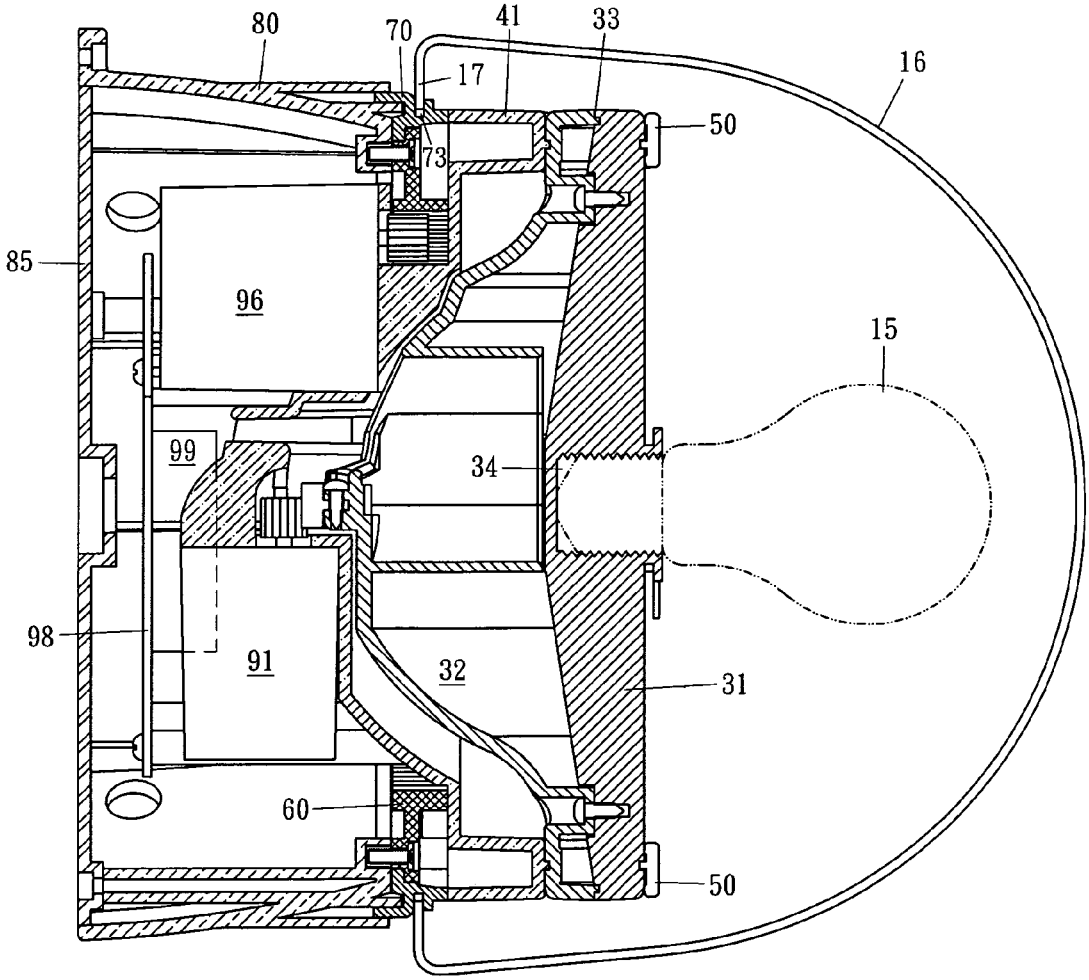
FIG. 7 is the schematic drawing of the wireless remote control porch light of the invention showing that a waterproof lampshade can be installed on the porch light.

Referred to FIG. 7, further example of embodiment of the wireless remote control porch light 10 is used a waterproof lampshade 16 instead of the aforesaid waterproof rubber sleeve 20. The waterproof lampshade 16 has an inner flange 17 formed on the bottom edge shown in FIG. 7. The waterproof lampshade 16 is installed on the rotation connecting seat 70 by inserting the flange 17 into the groove 73 of the rotation connecting seat 70 to form the wireless remote control porch light 10.

However the above-mentioned examples are the preferred embodiment of the invention. All the modifications and changes of any part of the invention which are the common knowledge of those skilled in the art who are familiar with doing such modification and change shall be covered by the claim of the invention.

What is claimed is:

1. A wireless remote control porch light used as a illuminating equipment installed on an outer wall or under the eaves of a building comprising base seat, a rotation connecting seat, a fixed seat, a rotation driving seat, a movable lamp holder and a waterproof rubber sleeve, wherein the fixed seat and the rotation connecting seat are jointly installed on the base seat, and the rotation connecting seat is pivotally connected to the base seat, characterized in that the base seat has a ring shaped protrusion;

the rotation connecting seat is a ring shaped part having a sliding groove and a flange;

wherein the sliding groove is for fitting the ring shaped protrusion of the base seat to maintain pivotal connection; and the rotation connecting seat further has a groove and plural connecting portions formed on an outer side;

the fixed seat is a ring shaped part having an internal ring gear which is installed on the base seat in such a way that the flange of the rotation connecting seat shall be stopped by the fixed seat, and a pivotal connection is maintained between the base seat and the rotation connecting seat;

the movable lamp holder has a pair of pivotal shafts, a light bulb socket with a flange surrounding the light bulb socket to form a ring shaped groove, and a circular gear rack formed on a back side;

the rotation driving seat has a recession for accommodating and installing the movable lamp holder, and the movable lamp holder is pivotally mounted on the rotation driving seat; the rotation driving seat has plural connecting portions on an outer side through which the rotation driving seat and the rotation connecting seat are assembled together to form a complete unit; the rotation driving seat further has an axial rotation driving device, a swivel driving device, and a radio signal receiver on a back side, wherein the axial rotation driving device comprises a reversible rotation motor and a driving gear which engages with the circular gear rack of the movable lamp holder;

the swivel driving device comprises a reversible rotation motor and a driving gear which engages with the internal ring gear of the fixed seat; and the radio signals receiver functions for receiving RF signal to control electric power supplied to the light bulb on the movable lamp holder and the reversible rotation motor of the axial rotation driving device and/or the swivel driving device; and the waterproof rubber sleeve is shaped like a cover and has an extendable and contractable wall with plaited structure, which has a connecting portion inserted into the ring shaped groove of the movable lamp holder, an inner flange on the inner edge of a bottom side for being installed into the groove of the rotation driving seat, and plural shielding covers mounted on the outer side of the connecting portion of the rotation driving seat.

2. The wireless remote control porch light as described in claim 1, wherein the fixed seat has two or more holes for selectively inserting a pin, and a stopper plate is formed on the back side of the rotation driving seat.

3. The wireless remote control porch light as described in claim 1, wherein the base seat has plural protrudent portions on the outer side of the bottom end.

4. The wireless remote control porch light as described in claim 2, wherein the base seat has plural protrudent portions on the outer side of the bottom end.

5. A wireless remote control porch light used as illuminating equipment installed on an outer wall or under the eaves of a building comprising a base seat, a rotation connecting seat, a fixed seat, a rotation driving seat, a movable lamp holder and a waterproof lampshade, wherein the fixed seat and the rotation connecting seat are jointly installed on the base seat, and the rotation connecting seat is pivotally connected to the base seat, characterized in that the base seat has a ring shaped protrusion;

the rotation connecting seat is a ring shaped part having a sliding groove and a flange;

wherein the sliding groove is for fitting the ring shaped protrusion of the base seat to maintain pivotal connection; and the rotation connecting seat further has a groove and plural connecting portions formed on an outer side;

the fixed seat is a ring shaped part having an internal ring gear which is installed on the base seat in such a way that the flange of the rotation connecting seat shall be stopped by the fixed seat, and a pivotal connection is maintained between the base seat and the rotation connecting seat;

the movable lamp holder has a pair of pivotal shafts, a light bulb socket and a circular gear rack formed on a back side;

the rotation driving seat has a recession for accommodating and installing the movable lamp holder, and the movable lamp holder is pivotally mounted on the rotation driving seat; the rotation driving seat has plural connecting portions on an outer side through which the rotation driving seat and the rotation connecting seat are assembled together to form a complete unit; the rotation driving seat further has an axial rotation driving device, a swivel driving device, and a radio signal receiver on a back side, wherein the axial rotation driving device comprises a reversible rotation motor and a driving gear which engages with the circular gear rack of the movable lamp holder;

the swivel driving device comprises a reversible rotation motor and a driving gear which engages with the internal ring gear of the fixed seat; and the radio signals receiver functions for receiving RF signal to control electric power supplied to the light bulb on the movable lamp holder and the reversible rotation motor of the axial rotation driving device and/or the swivel driving device; and the waterproof lampshade has an inner flange formed on the bottom edge and is inserted into the groove of the rotation connecting seat.

6. The wireless remote control porch light as described in claim 5, wherein the fixed seat has two or more holes for being selectively inserting a pin, and a stopper plate is formed on the back side of the rotation driving seat.

7. The wireless remote control porch light as described in claim 5, wherein the base seat has plural protrudent portions on the outer side of the bottom end.

8. The wireless remote control porch light as described in claim 6, wherein the base seat has plural protrudent portions on the outer side of the bottom end.

* * * * *